US010866058B2

(12) United States Patent
Maeda

(10) Patent No.: US 10,866,058 B2
(45) Date of Patent: Dec. 15, 2020

(54) DEVICE FOR ATTACHMENT-DETACHMENT OF SLIDE FOR TOY GUN

(71) Applicant: MARUZEN COMPANY LIMITED, Tokyo (JP)

(72) Inventor: Tetsuo Maeda, Tokyo (JP)

(73) Assignee: MARUZEN COMPANY LIMITED, Tokyo (JP)

( * ) Notice: Subject to any disclaimer, the term of this patent is extended or adjusted under 35 U.S.C. 154(b) by 0 days.

(21) Appl. No.: 16/728,809

(22) Filed: Dec. 27, 2019

(65) Prior Publication Data

US 2020/0208940 A1 Jul. 2, 2020

(30) Foreign Application Priority Data

Dec. 28, 2018 (JP) ..... 2018-248133

(51) Int. Cl.

| | |
|---|---|
| ***F41B 7/08*** | (2006.01) |
| ***F41B 11/70*** | (2013.01) |
| ***F41B 7/00*** | (2006.01) |
| *F41A 3/66* | (2006.01) |

(52) U.S. Cl.

CPC ..... *F41B 11/70* (2013.01); *F41B 7/003* (2013.01); *F41B 7/08* (2013.01); *F41A 3/66* (2013.01)

(58) Field of Classification Search

CPC ..... F41B 7/003; F41B 7/08

See application file for complete search history.

(56) References Cited

U.S. PATENT DOCUMENTS

| | | | | |
|---|---|---|---|---|
| 8,402,956 | B2 * | 3/2013 | Dakan | F41B 7/006 124/27 |
| 8,448,365 | B2 * | 5/2013 | Mead | F41B 7/003 42/54 |
| 8,950,100 | B2 | 2/2015 | Nebeker et al. | |
| 9,347,735 | B2 * | 5/2016 | Falkowski, II | F41B 7/003 |

(Continued)

FOREIGN PATENT DOCUMENTS

EP 1 939 576 A1 7/2008

OTHER PUBLICATIONS

The extended European search report mailed in European Patent Application No. 19219584.0, dated May 27, 2020.

(Continued)

*Primary Examiner* — John A Ricci

(74) *Attorney, Agent, or Firm* — Michael Best & Friedrich LLP

(57) ABSTRACT

A device for attachment-detachment of a slide for toy gun only by operating a single lever without using any tool, includes a toy gun body, a slide at an upper part of the toy gun body while covering a barrel, and slidingly movable in directions toward the barrel and rear side of the toy gun, a takedown lever disposed on the toy gun body surface at a boundary with the slide, and rotatingly movable along the toy gun body surface, and a slide block crank that comes in contact with a slide block abutment portion of a shaft support portion of the slide to prevent the slide from moving toward the rear end side, and moves in muzzle/non-muzzle directions accompanying with the rotating motion of the takedown lever. The slide block crank extends closer to a muzzle in moving in the muzzle direction than in moving in the non-muzzle direction.

9 Claims, 13 Drawing Sheets

(56) References Cited

U.S. PATENT DOCUMENTS

| | | | | |
|---|---|---|---|---|
| 2008/0072470 | A1* | 3/2008 | Wang | F41C 3/005<br>42/54 |
| 2014/0317982 | A1 | 10/2014 | Gentilini et al. | |
| 2016/0377365 | A1 | 12/2016 | Lee | |
| 2017/0227313 | A1 | 8/2017 | Dechant | |

OTHER PUBLICATIONS

Search Report issued in Taiwan Application No. 108147510, dated Aug. 14, 2020.

* cited by examiner

DEVICE FOR ATTACHMENT-DETACHMENT OF SLIDE FOR TOY GUN

CROSS REFERENCE TO RELATED APPLICATION

The present application is based on and claims the benefit of priority of Japanese Patent Application No. 2018-248133 filed on Dec. 28, 2018, the entire contents of which is incorporated herein by reference.

TECHNICAL FIELD

The present invention relates to a device for attachment-detachment of a slide for a toy gun. Specifically, the present invention relates to a device for attachment-detachment of the slide for the toy gun in which the slide is externally attached along a barrel which is provided to an air gun.

BACKGROUND ART

The slide is externally attached to the toy gun along the barrel.

For example, Japanese Unexamined Patent Application Publication No. 2013-217546 titled "Bullet shooting mechanism of air gun" discloses that "an air gun 101 including a slide attached slidably onto a side surface of the gun in a direction toward the rear end of the gun allows the slide to slidingly move in the direction toward the rear end of the gun, and then to return to the initial position so that preparation for shooting is completed" (see [0012]).

Japanese Unexamined Patent Application Publication No. 2012-017947 titled "Air gun" discloses that "A feeder port 105 for loading BB bullets is opened at the rear side of a muzzle 104. A slide 107 is disposed near the feeder port 105. The slide 107 includes a bullet push-in portion 108 and a slide operation portion 109, and slidably moves in the longitudinal direction of the barrel 103." (see [0023]).

Japanese Unexamined Patent Application Publication No. 2010-121923 titled "Seal structure for toy air gun" discloses that "in the embodiment, the seal structure according to the present invention is applied to the inner barrel 3 of the toy air gun 1 as shown in FIG. 1. In brief, the toy air gun 1 shown in FIG. 1 is formed to have a blowback structure designed to allow the slide 4 disposed at the upper part of the gun body 2 to move backward." (see [0022]).

Japanese Patent No. 4356036 titled "Seal structure for toy air gun" discloses that "in the embodiment, the seal structure according to the present invention is applied to the inner barrel 3 of the toy air gun 1 as shown in FIG. 1. In brief, the toy air gun 1 shown in FIG. 1 is formed to have a blowback structure designed to allow the slide 4 disposed at the upper part of the gun body 2 to move backward." (see [0026]).

FIGS. 15 to 26 show reference examples.

A reference numeral 101 denotes a toy gun as a reference example. A reference numeral 102 denotes a toy gun body of the toy gun 101 of the reference example. A reference numeral 103 denotes a slide. A reference numeral 121 denotes a barrel. The slide 103 is attached to the upper part of the toy gun body 102 that is slidable in directions toward the muzzle side and the rear side of the gun while covering the outer side of the barrel 121.

A reference numeral 104 denotes a pin insertion hole. The pin insertion hole 104 is formed in a side surface of the toy gun body 102. A reference numeral 105 denotes a pin. The pin 105 is inserted into the pin insertion hole 104. A reference numeral 106 denotes a dummy takedown lever.

The dummy takedown lever 106 is attached to the lower side surface of the slide 103 of the toy gun body 102 while imitating the real gun, but does not work actually. A reference numeral 107 denotes a slide block hole. The slide block hole 107 is opened in the lower part of the slide 103 of the toy gun body 102 while being directed downward.

A reference numeral 111 denotes a mechanical frame.

A reference numeral 131 denotes a slide block. The slide block 131 has an L-like shape constituted by a long horizontal side, and a short vertical side, and is attached to the mechanical frame 111 while having the short side directed downward.

A reference numeral 132 denotes a slide block abutment portion. The slide block abutment portion 132 is attached to an end of the mechanical frame 111 at the muzzle side below the slide 103. When housing the slide block 131, the slide block abutment portion 132 comes in contact with the end of the slide block 131 at the muzzle side.

A reference numeral 133 denotes a slide block second abutment portion. The slide block second abutment portion 133 is attached to the lower part of the slide block abutment portion 132 at the end of the mechanical frame 111 at the muzzle side. The pin insertion hole 104 is formed while penetrating through the slide block 131 from the side surface of the slide 103.

In the normal state in which the slide 103 is fixed to the toy gun body 102, as shown in FIG. 15 the pin 105 is inserted into the pin insertion hole 104 to penetrate to the one formed in the slide block 131. The pin 105 serves to fix the slide block 131 to the toy gun body 102.

The slide 103 can move slidingly backward as shown in FIGS. 17 and 23. When a leading end of the barrel 121 is exposed, the leading end of the slide block 131 abuts on the slide block abutment portion 132. As the slide block 131 no longer moves toward the muzzle side, the slide 103 cannot be removed.

When detaching the slide 103 from the toy gun body 102, the pin 105 that fixes the slide block 131 to the toy gun body 102 is pulled out from the pin insertion hole 104 as shown in FIG. 16. Then as FIGS. 24, 25, and 26 show, the slide block 131 moves down to expose the top end of the vertical side from the slide block hole 107.

The slide 103 becomes ready for further moving backward, and detachable from the toy gun body 102.

In the reference example and the example of the generally employed product, operations for pulling or inserting the pin 105, and the use of the tool such as a hammer have been required for attachment/detachment of the slide 103 to/from the toy gun body 102.

SUMMARY OF THE INVENTION

The present invention provides a toy gun (air gun) configured to operate the single lever to detach a slide.

One embodiment of the device for attachment-detachment of slide for a toy gun of the present invention comprising:

a slide disposed at an upper part of the toy gun body while covering a barrel, and slidingly moving toward a muzzle of the barrel, and toward a rear end side of the toy gun;

a takedown lever disposed on a surface of the toy gun body at a boundary with the slide, the takedown lever being rotatingly movable along the surface of the toy gun body; and a slide block crank that comes in contact with a part of the slide or a part connected to the slide directly or indirectly to prevent the slide from moving toward the rear side of the gun, and moves in a muzzle direction and a non-muzzle direction accompanying with the rotating movement of the takedown lever, the slide block crank being closer to the muzzle in moving in the muzzle direction than in moving in the non-muzzle direction.

One embodiment of the device for attachment-detachment of slide for a toy gun of the present invention further comprising:

a slide block slide shaft to be disposed parallel to the barrel;

a shaft support portion to be slidably attached to the slide block slide shaft below the slide at a side of the muzzle;

a slide block abutment portion that constitutes a side surface of the shaft support portion at the rear side of the gun; and a slide block configured to be attached to the slide block slide shaft to be movable in the muzzle direction and the non-muzzle direction, and to come in contact with the slide block abutment portion of a shaft support portion, wherein the slide block crank comes in contact with the slide block to prevent the slide from moving toward the rear side of the gun.

One embodiment of the device for attachment-detachment of slide for a toy gun of the present invention, wherein the slide block crank is movable in the muzzle direction or in the non-muzzle direction, and configured to come in contact with a slide block that contacts with the part of the slide or the part connected to the slide to prevent the slide from moving toward the rear side of the gun.

One embodiment of the device for attachment-detachment of slide for a toy gun of the present invention, wherein the device for attachment-detachment of slide for toy gun according to any one of claims 1 to 3, wherein the slide block crank moves in the muzzle direction accompanying with a horizontal rotating motion of the takedown lever, and moves in the non-muzzle direction accompanying with a vertical rotating motion of the takedown lever.

One embodiment of the device for attachment-detachment of slide for a toy gun of the present invention, wherein the slide block crank moves toward the muzzle direction accompanying with the horizontal rotating motion of the takedown lever to come in contact with the slide block abutment portion of the shaft support portion, and vertically moves accompanying with the vertical rotating motion of the takedown lever so that a space is generated between the slide block crank and the slide block.

One embodiment of the device for attachment-detachment of slide for a toy gun of the present invention further comprising a takedown operation groove to be formed across a surface between the slide and the toy gun body for guiding the takedown lever to rotatingly move in a horizontal direction, and to operate in a vertical direction.

One embodiment of the device for attachment-detachment of slide for a toy gun of the present invention, wherein the takedown operation groove is formed across the surface between the slide and the toy gun body.

One embodiment of the device for attachment-detachment of slide for a toy gun of the present invention, wherein the takedown operation groove includes a toy gun body side takedown operation groove and a slide side takedown operation groove, the toy gun body side takedown operation groove is formed in a surface of the toy gun body, constituting a lower half of an arc shape, the slide side takedown operation groove is formed in a surface of the slide, constituting an upper half of the arc shape, and linkage between the toy gun body side takedown operation groove and the slide side takedown operation groove forms the arc shape serving as a guide.

One embodiment of the device for attachment-detachment of slide for a toy gun of the present invention, wherein sliding of the slide toward the rear side of the gun allows the linkage between the toy gun body side takedown operation groove and the slide side takedown operation groove to form the arc shape serving as the guide.

A slide block crank comes in contact directly or indirectly with a part of the slide or a part connected to the slide to block the movement of the slide toward the rear side of the gun. The slide block crank further moves accompanying with rotating of the takedown lever in directions toward the muzzle side, and toward the non-muzzle side, and extends closer to the muzzle side in moving toward the muzzle side than in moving toward the rear side of the gun.

Rotating motion of the takedown lever varies the sliding amount of the slide to the rear side of the gun.

If a takedown operation groove is formed between the slide and the toy gun body for guiding the takedown lever operation, the takedown lever is operated upon formation of the takedown operation groove through the linkage between the slide and the toy gun body.

The slide of the air gun may be detached by operating the single lever without using a tool. This allows a toy gun user to easily perform maintenance operations such as cleaning and oiling, and further improvement in production efficiency. This also allows easy replacement of the defective slide.

According to the present invention, the toy gun is operated in accordance with the procedure for operating the real gun. Actually, the real gun has the slide detached toward the muzzle side together with the barrel. As the blowback gas gun includes an air chamber at the rear side of the barrel, the slide has to be detached independently toward the rear side of the gun.

DESCRIPTION OF THE EMBODIMENTS

Figure 1:
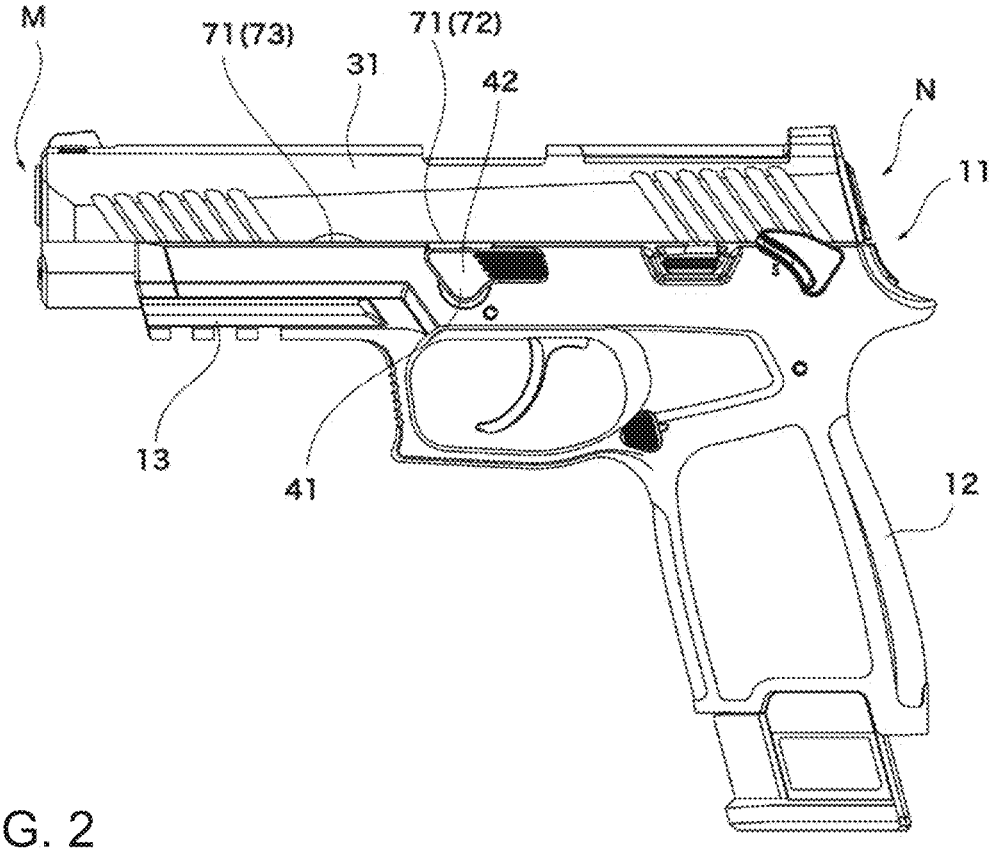
FIG. 1 is a front view of a toy gun as an example of an embodiment according to the present invention, representing the state of the slide before sliding from the toy gun body.

An example of an embodiment according to the present invention will be described referring to the drawings.

A toy gun 11 includes a toy gun body 12, a barrel 21, and a slide 31. The barrel 21 is disposed at the upper part of the toy gun body 12 while extending between a muzzle side M and a rear end side N. A reference numeral 13 denotes a frame. The frame 13 is disposed on the surface of the toy gun body 12.

A reference numeral 14 denotes a mechanical frame 14. The mechanical frame 14 is attached to an inner side of the toy gun body 12 below the slide 31.

The slide 31 at the upper part of the toy gun body 12 covers the barrel 21 to be slidably attached to the toy gun body 12 along the longitudinal direction toward the muzzle side M and the rear end side N with the mechanical frame 14.

A reference numeral 32 denotes a shaft support portion. The shaft support portion 32 is attached to the lower part of the slide 31 at the muzzle side M while projecting downward. A reference numeral 33 denotes a slide block abutment portion. The slide block abutment portion 33 constitutes the side surface of the shaft support portion 32 at the rear end side N.

Reference numerals 41 and 42 denote a takedown lever and a takedown lever rotary shaft, respectively. The takedown lever rotary shaft 42 is attached to the mechanical frame 14 below the slide 31. The takedown lever 41 is attached along the surface of the toy gun body 12 at the boundary with the slide 31 thereon, and rotatable around the takedown lever rotary shaft 42 as a rotary axis.

A reference numeral 43 denotes a takedown convex portion 43. The takedown convex portion 43 is attached to a top end of the takedown lever 41 at the inner side while being directed to the inside of the toy gun body 12.

A reference numeral 51 denotes a takedown link. The takedown link 51 has one end attached to the inner side of the top end of the takedown lever 41.

A reference numeral 51 denotes a link convex portion. The link convex portion 52 is attached to the other end of the takedown link 51. The link convex portion 52 is convexly attached to the inner side of the mechanical frame 14.

Reference numerals 53 and 531 denote a crank and a crank groove, respectively. The crank groove 531 is formed in the center of the crank 53 in the longitudinal direction. The link convex portion 52 engaged with the crank groove 531 is guided by the crank groove 53. A reference numeral 54 denotes a crank shaft.

A reference numeral 55 denotes a slide block crank. The crank 53 and the slide block crank 55 are connected while forming a V-like shape at an angle of substantially 120°. The crank 53 and the slide block crank 55 in connection with each other are attached to the mechanical frame 14 at the connected portion using the crank shaft 54. The crank 53 and the slide block crank 55 are rotatable around the crank shaft 54.

A reference numeral 59 denotes a slide block backward abutment portion. The slide block backward abutment portion 59 is disposed on the attachment base portion of the crank shaft 54 while being directed to the muzzle side M.

Reference numerals 56 and 57 denote a slide block and a slide block slide shaft, respectively. The slide block slide shaft 57 penetrates through the shaft support portion 32 of the slide 31, and slidably attached thereto. It is slidably supported with the shaft support portion 32.

The slide block slide shaft 57 is disposed in the range corresponding to substantially one third of the length of the barrel 21 from under the muzzle side M to the rear end side N below the barrel 21, while being parallel to the barrel 21.

The slide block 56 is attached to the slide block slide shaft 57 at the rear end side N. The slide block 56 is attached to the mechanical frame 14 together with the slide block slide shaft 57, which are slidable in directions toward the muzzle side M and the rear end side N.

Accompanying with the sliding motion of the shaft support portion 32 along the slide block slide shaft 57 in directions toward the muzzle side M and the rear end side N, the slide 31 slidingly moves in directions toward the muzzle side M and the rear end side N.

A reference numeral 58 denotes a crank abutment portion. The crank abutment portion 58 is disposed to the side surface of the slide block 56 at the rear end side N.

Referring to FIGS. 2, 3, 9, 10, and 12, when the slide 31 has not slidingly reached the rear end, the fitted state of the slide block backward abutment portion 59 to the crank abutment portion 58 is released.

Figure 13:
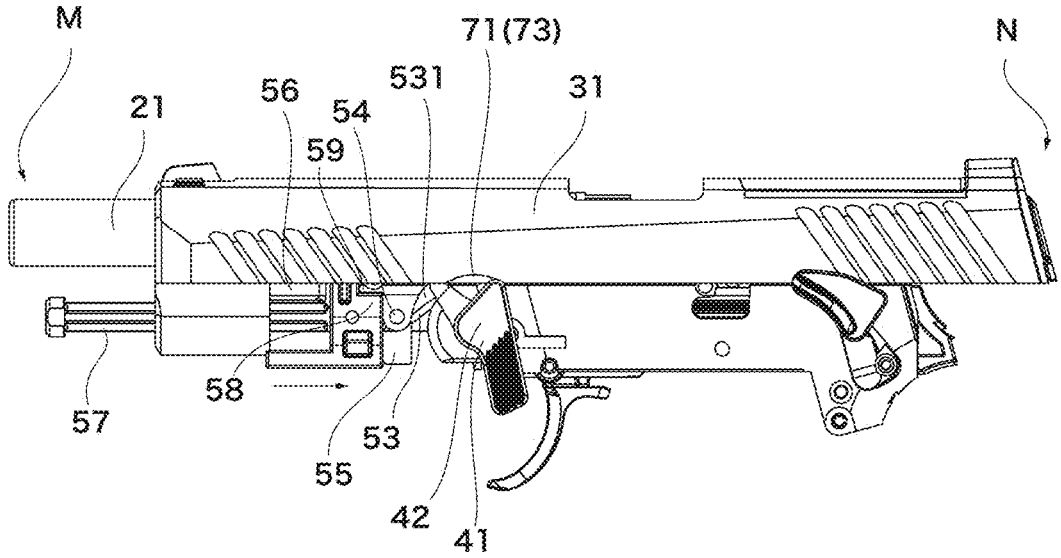
FIG. 13 is a partially enlarged front sectional view of the toy gun as an example of an embodiment according to the present invention, representing that the slide is in the state after sliding from the toy gun body, and the takedown lever is in the state after operation.
Figure 14:
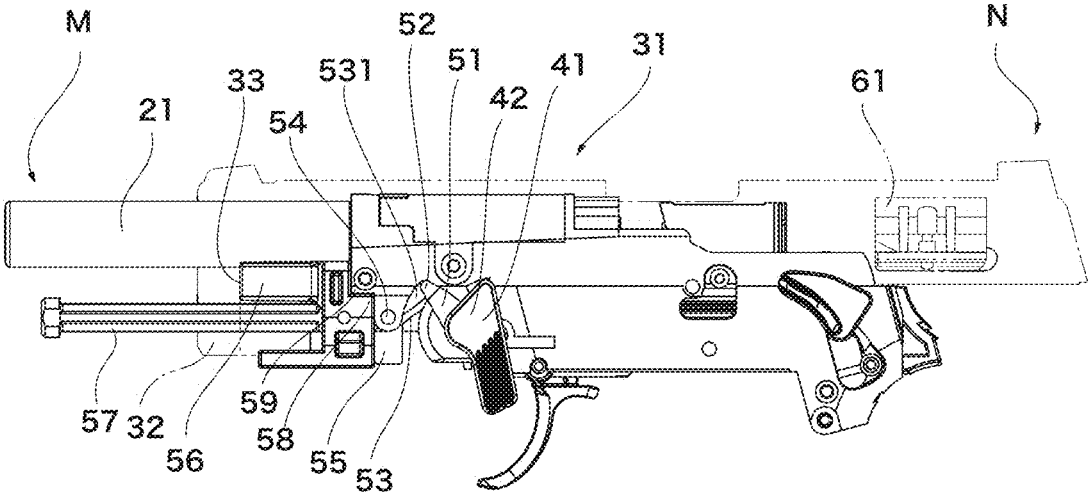
FIG. 14 is a partially enlarged front sectional view of the toy gun as an example of an embodiment according to the present invention, representing that the slide is in the state after sliding from the toy gun body, and the takedown lever is in the state after operation.
Figure 15:
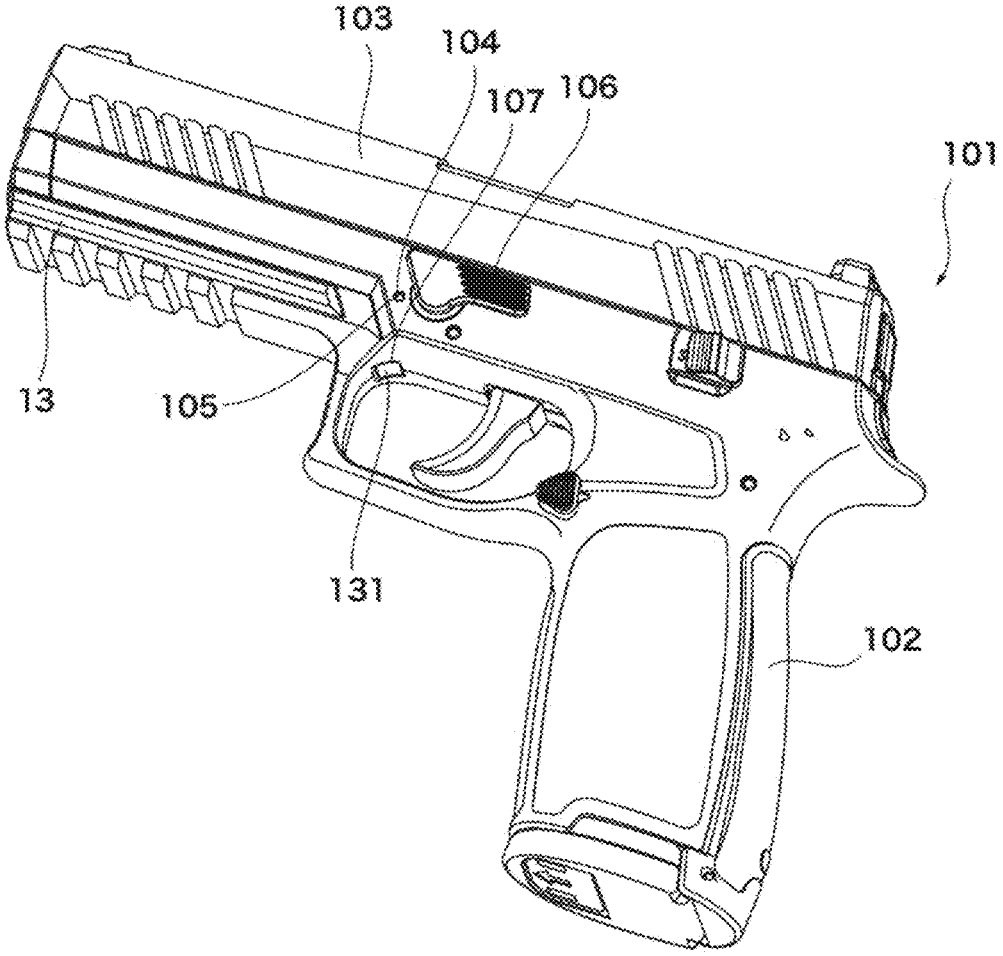
FIG. 15 is a perspective view of a generally employed structure representing that the slide is in the state before sliding from the toy gun body, and a leading end of a slide block is in an unexposed state from a slide block hole.
Figure 16:
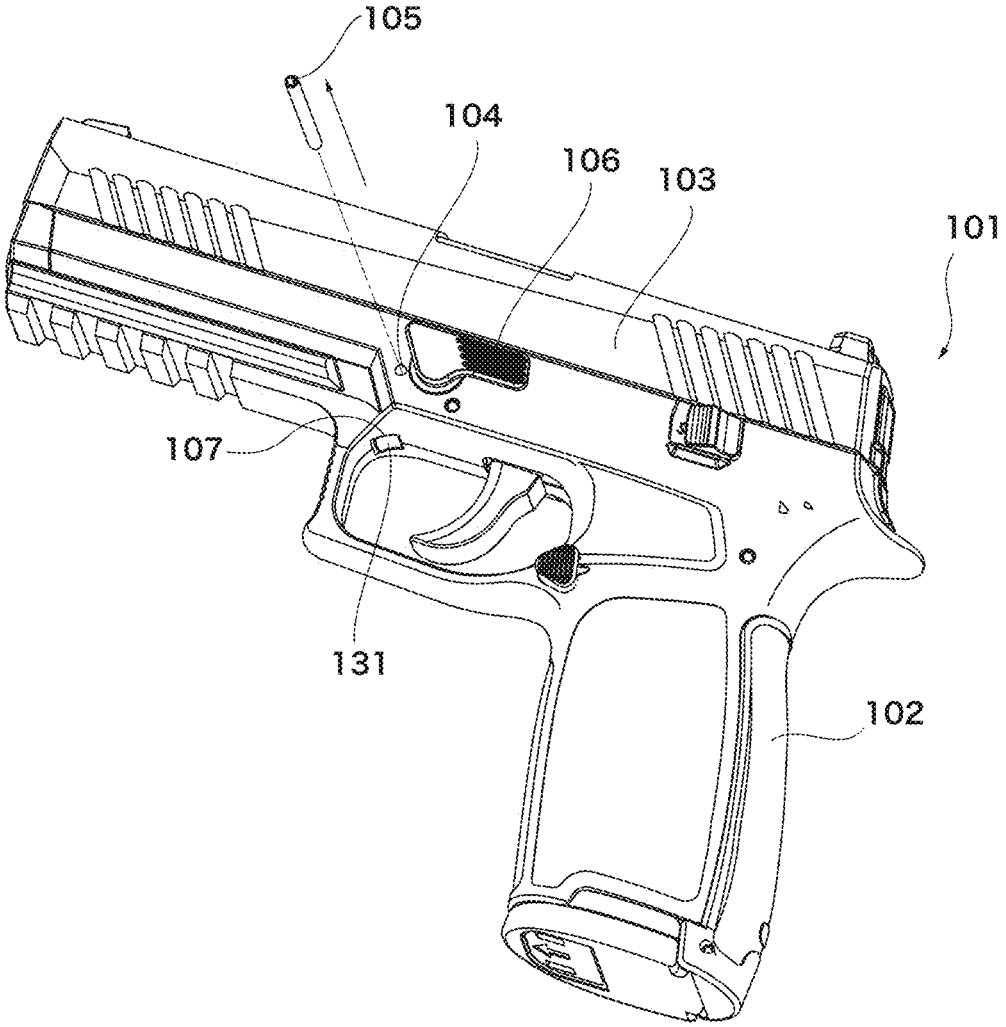
FIG. 16 is a perspective view of a generally employed structure representing that the slide is in the state before sliding from the toy gun body, the pin has been pulled out, and the leading end of the slide block is in the unexposed state from the slide block hole.
Figure 17:
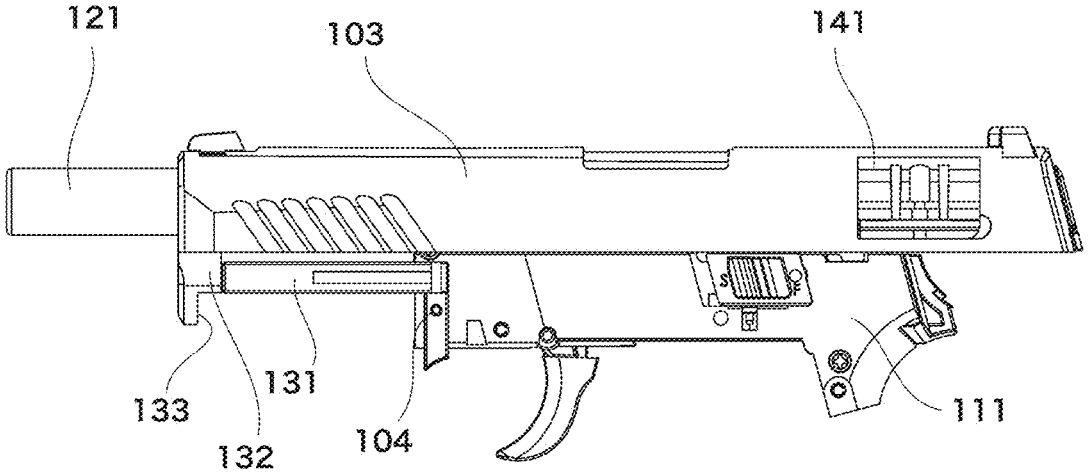
FIG. 17 is a partially enlarged front view of a generally employed structure, representing that the slide is in the state after sliding from the toy gun body, and the leading end of the slide block is in the unexposed state from the slide block hole.
Figure 18:
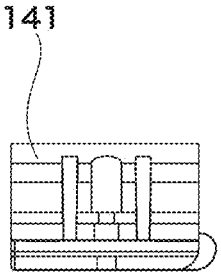
FIG. 18 is a front view of a generally employed cylinder block.
Figure 19:
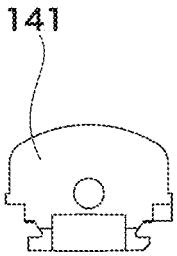
FIG. 19 is a right side view of the generally employed cylinder block.
Figure 20:
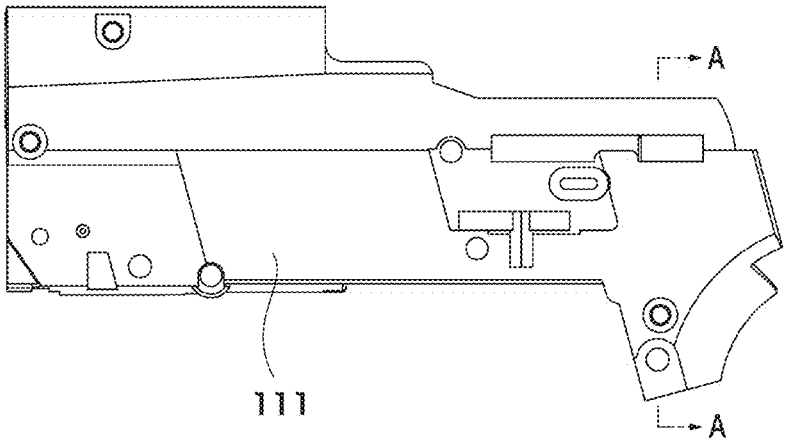
FIG. 20 is a front view of a generally employed mechanical frame.
Figure 21:
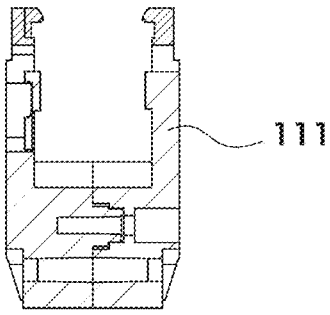
FIG. 21 is a right side sectional view of the generally employed mechanical frame taken along line A-A of FIG. 20.
Figure 22:
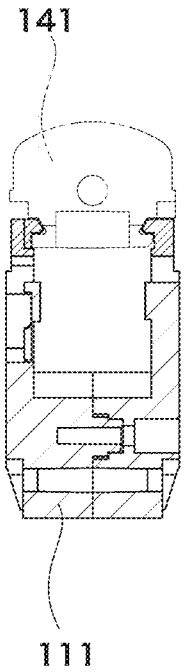
FIG. 22 is a right side view of the generally employed mechanical frame, and the generally employed cylinder block.
Figure 23:
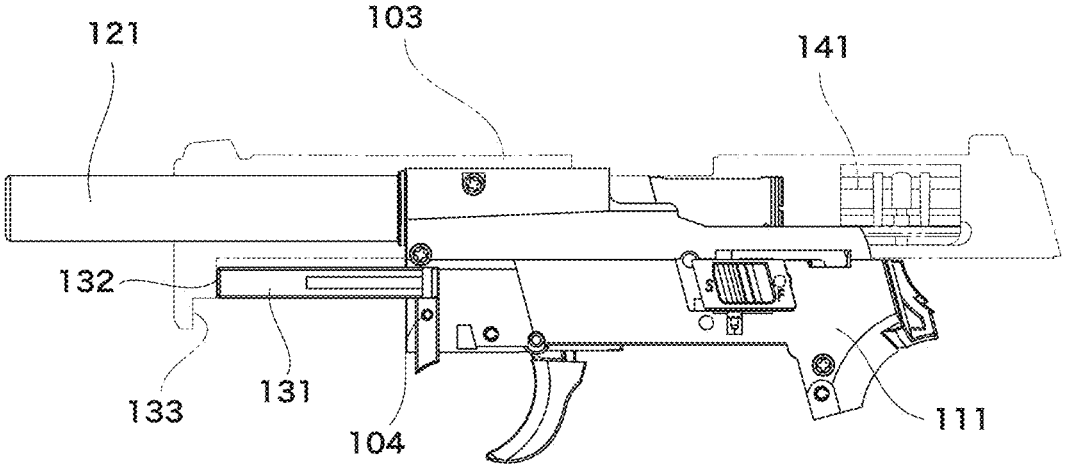
FIG. 23 is a partially enlarged front sectional view of the generally employed cylinder in sliding, representing that the slide is in the state after sliding from the toy gun body, and the leading end of the slide block is in the unexposed state from the slide block hole.
Figure 24:
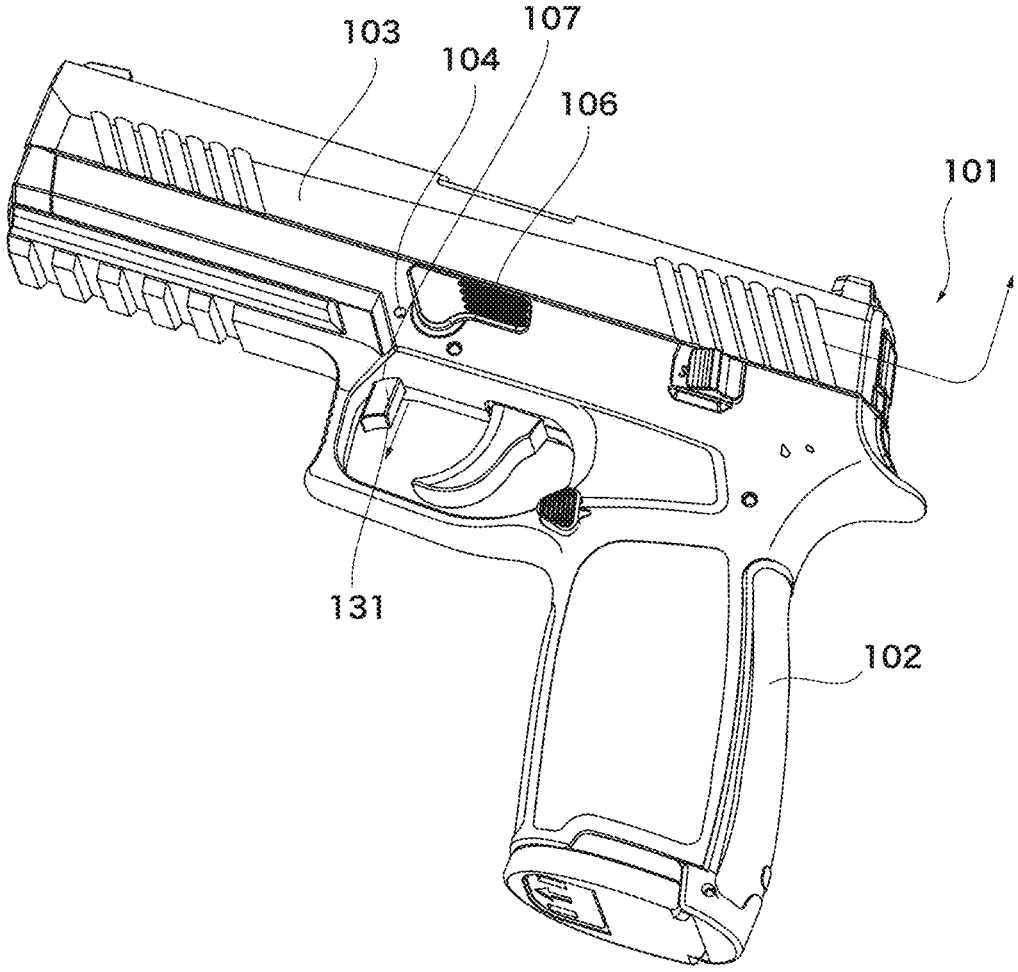
FIG. 24 is a perspective view of a generally employed structure, representing that the slide is in the state before sliding from the toy gun body, and the leading end of the slide block is in the exposed state from the slide block hole.
Figure 25:
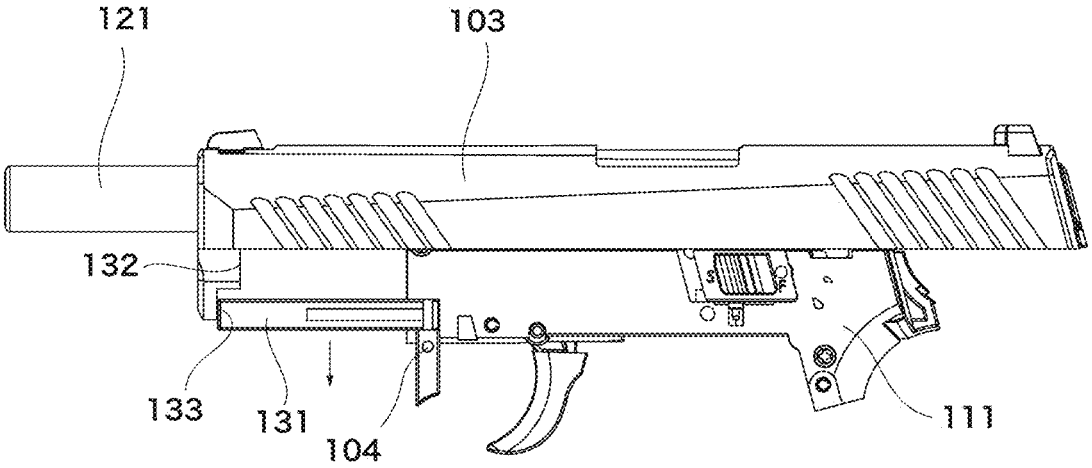
FIG. 25 is a partially enlarged front view of a generally employed cylinder in sliding, representing that the slide is in the state after sliding further from the toy gun body, and the leading end of the slide block is in the exposed state from the slide block hole.
Figure 26:
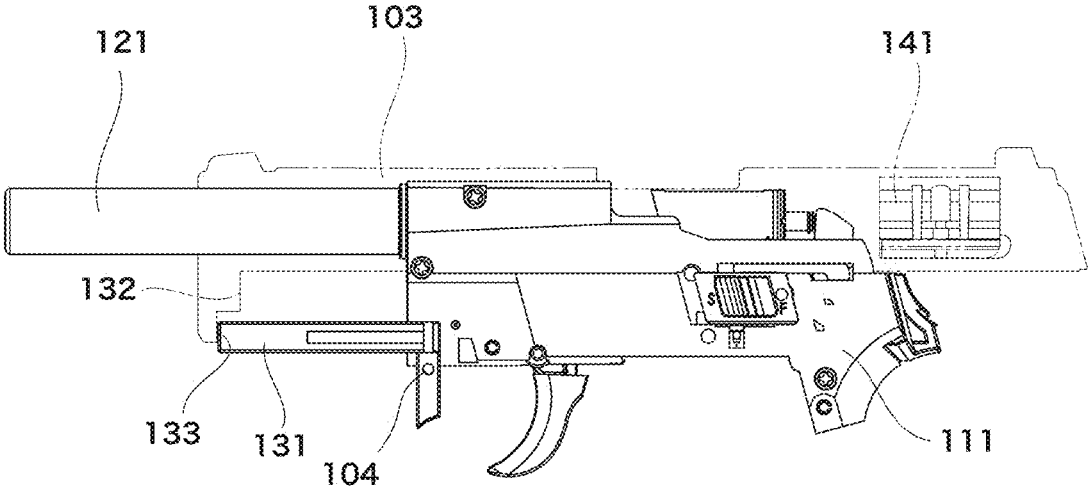
FIG. 26 is a partially enlarged front view of a generally employed cylinder in sliding, representing that the slide is in the state after sliding further from the toy gun body, and the leading end of the slide block is in the exposed state from the slide block hole.

Referring to FIGS. 13 and 14, when the slide 31 slidingly reaches the rear end, the slide block backward abutment portion 59 is fitted and fixed to the crank abutment portion 58.

A reference numeral 61 denotes a cylinder block.

Figure 2:
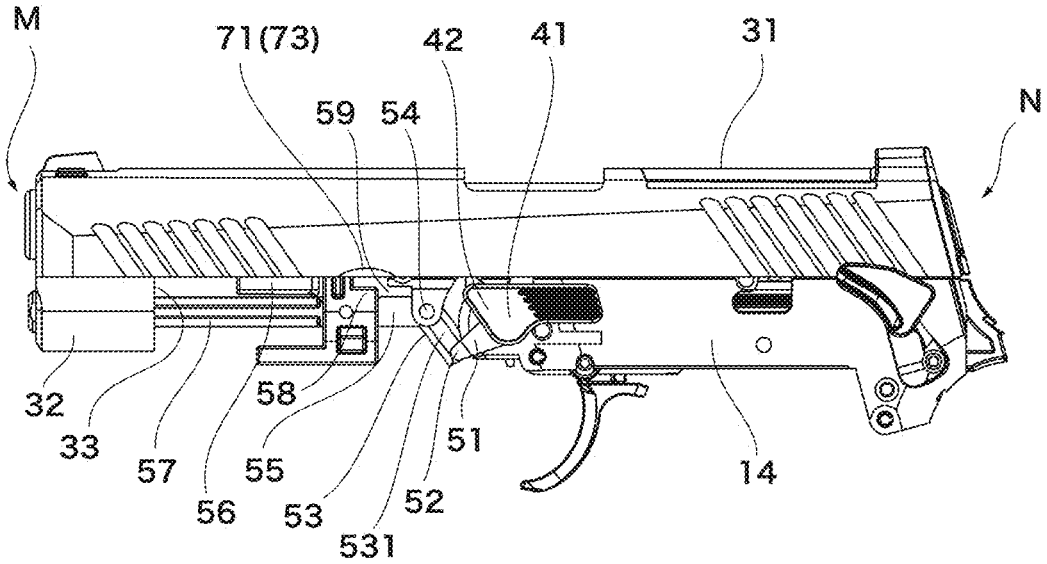
FIG. 2 is a partially enlarged front view of the toy gun as an example of an embodiment according to the present invention, representing the state of the slide before sliding from the toy gun body.
Figure 9:
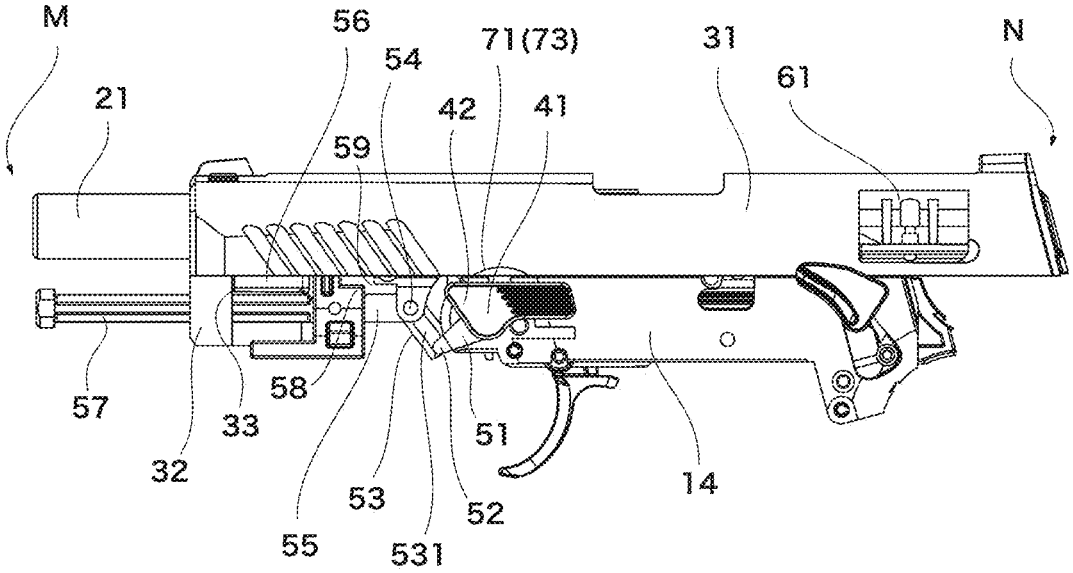
FIG. 9 is a partially enlarged front sectional view of the toy gun as an example of an embodiment according to the present invention, representing that the slide is in the state after sliding from the toy gun body, and the takedown lever is in the state before operation.

As shown in FIG. 2, when the slide 31 is kept from sliding to the rear end side N, the slide block abutment portion 33 does not abut on the muzzle side M, that is, the leading end of the slide block 56, thus leaving a gap therebetween. As the slide 31 is slidingly moved to the rear end side N, the slide block abutment portion 33 abuts on the muzzle side M, that is, the leading end of the slide block 56 as shown in FIG. 9.

Figure 12:
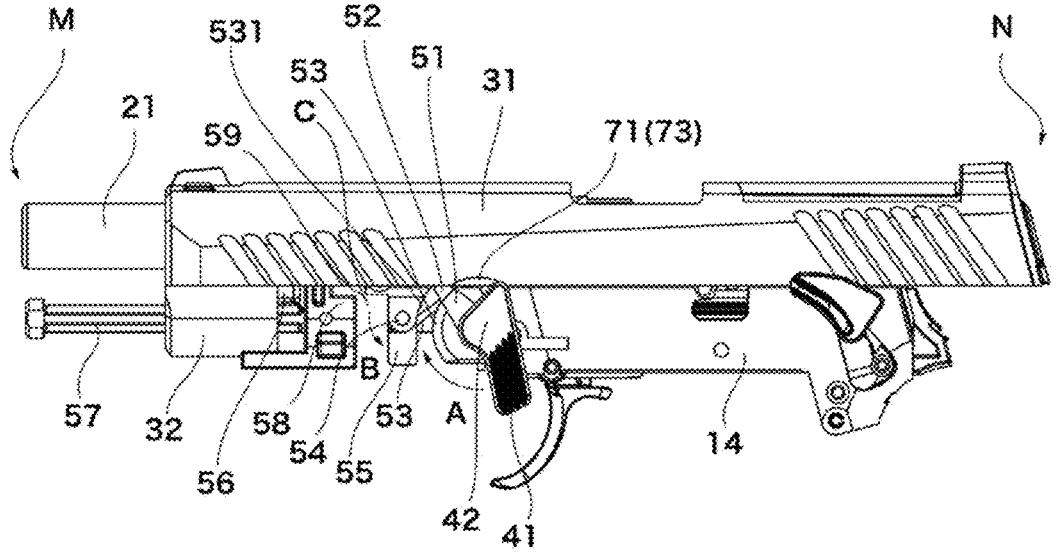
FIG. 12 is a partially enlarged front sectional view of the toy gun as an example of an embodiment according to the present invention, representing that the slide is in the state after sliding from the toy gun body, and the takedown lever is in the state after operation.

As shown in FIG. 12, the slide block crank 55 rotatably moves in the directions toward the muzzle side M and the non-muzzle side (in this example, vertically downward direction) accompanying with a rotating motion A of the takedown lever 41 around the crank shaft 54. Simultaneously, the slide block crank 55 is allowed to come in contact with a part of the slide 31 or a part connected thereto (in this example, the slide block abutment portion 33 of the shaft support portion 32) in moving toward the muzzle side M.

The slide block crank 55 moves in the direction toward the muzzle side M accompanying with rotating motion of the takedown lever 41 in the horizontal direction, and comes in contact with the part of the slide 31 or the part connected thereto. The slide block crank 55 moves with a rotating motion B toward the non-muzzle side accompanying with the vertical rotating motion of the takedown lever 41 (in this example, vertically downward direction).

Figure 4:
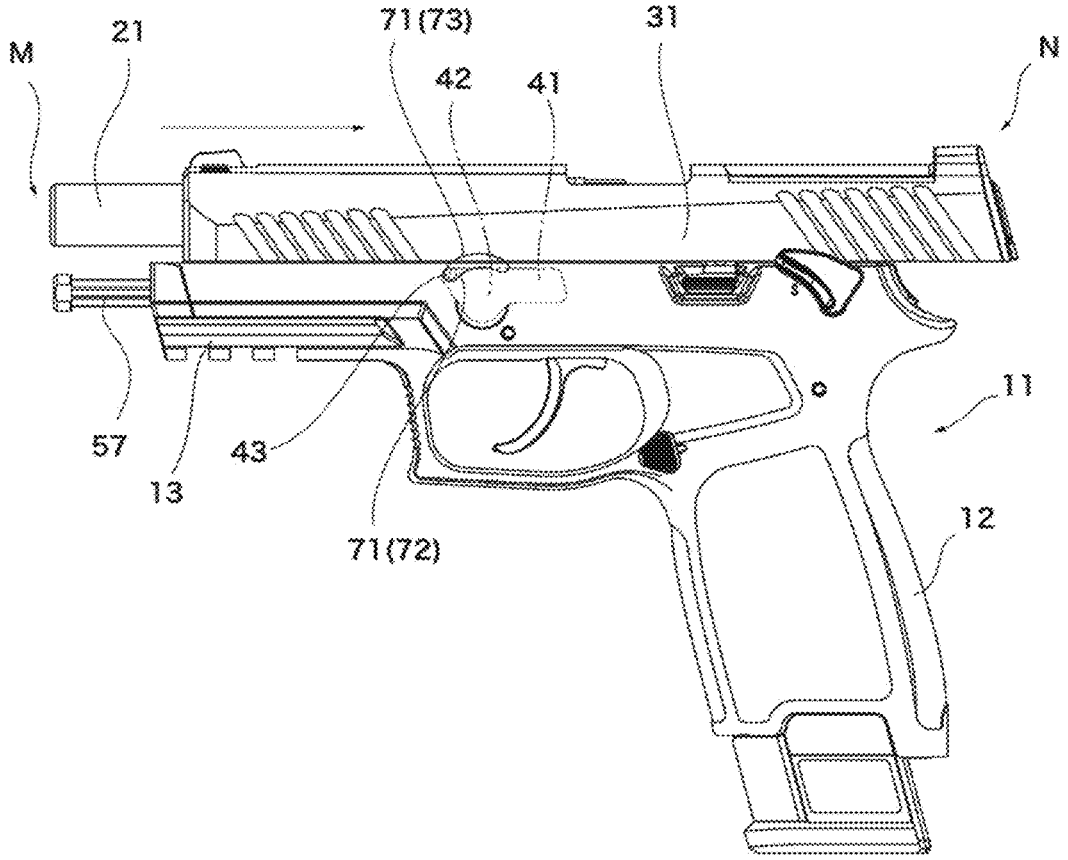
FIG. 4 is a front view of the toy gun as an example of an embodiment according to the present invention, representing that the slide is in the state after sliding from the toy gun body, and the takedown lever is in the state before operation.
Figure 5:
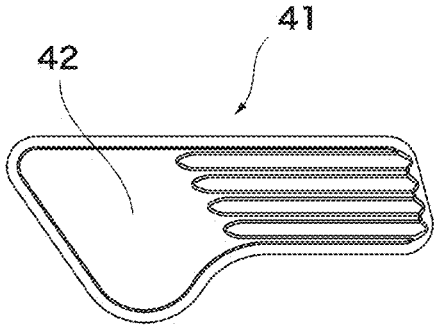
FIG. 5 is a front view of the takedown lever of the toy gun as an example of an embodiment according to the present invention.
Figure 6:
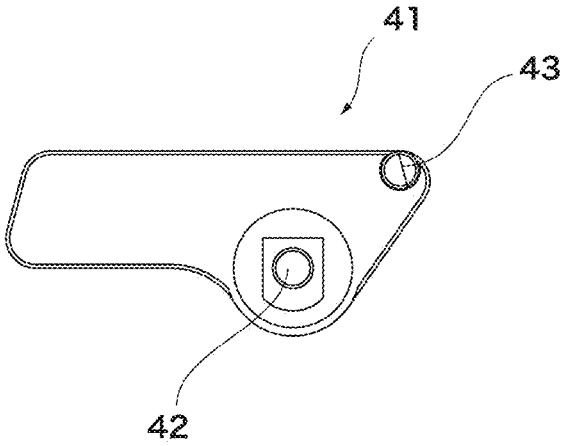
FIG. 6 is a back view of the takedown lever of the toy gun as an example of an embodiment according to the present invention.
Figure 7:
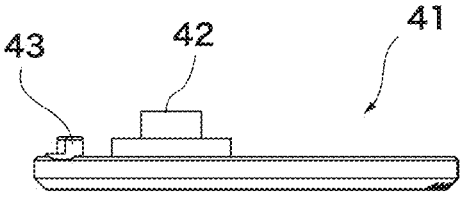
FIG. 7 is a plan view of the takedown lever of the toy gun as an example of an embodiment according to the present invention.
Figure 8:
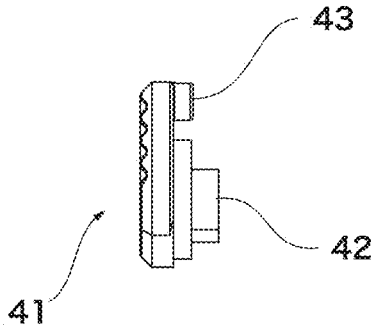
FIG. 8 is a left side view of the takedown lever of the toy gun as an example of an embodiment according to the present invention.
Figure 11:
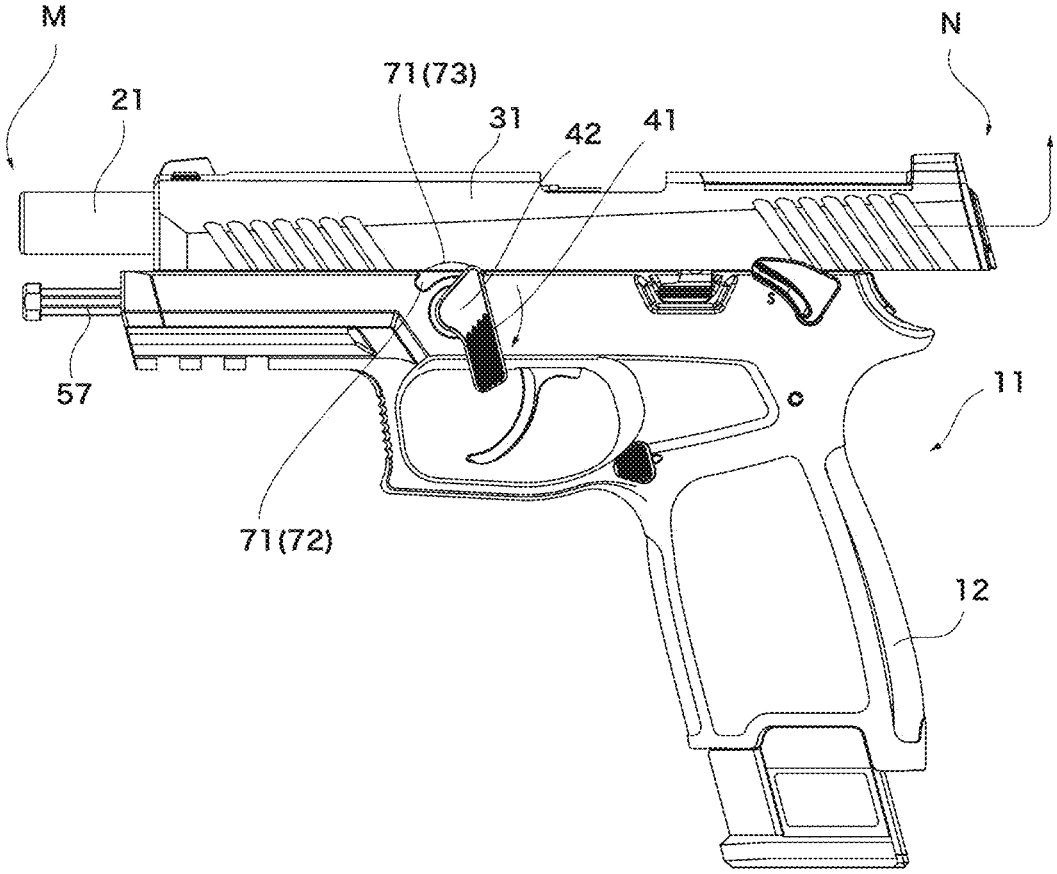
FIG. 11 is a front view of the toy gun as an example of an embodiment according to the present invention, representing that the slide is in the state after sliding from the toy gun body, and the takedown lever is in the state after operation.

A reference numeral 71 denotes a takedown operation groove. The takedown operation groove 71 is constituted by a toy gun body side takedown operation groove 72, and a slide side takedown operation groove 73. The toy gun body side takedown operation groove 72 is formed in the surface of the toy gun body 12. The slide side takedown operation groove 73 is formed in the surface of the slide 31. As shown in FIGS. 4 and 11, the toy gun body side takedown operation groove 72 constitutes a lower half of an arc shape, and the slide side takedown operation groove 73 constitutes an upper half of the arc shape.

The takedown operation groove 71 is formed across the surface between the slide 31 and the toy gun body 12.

Figure 3:
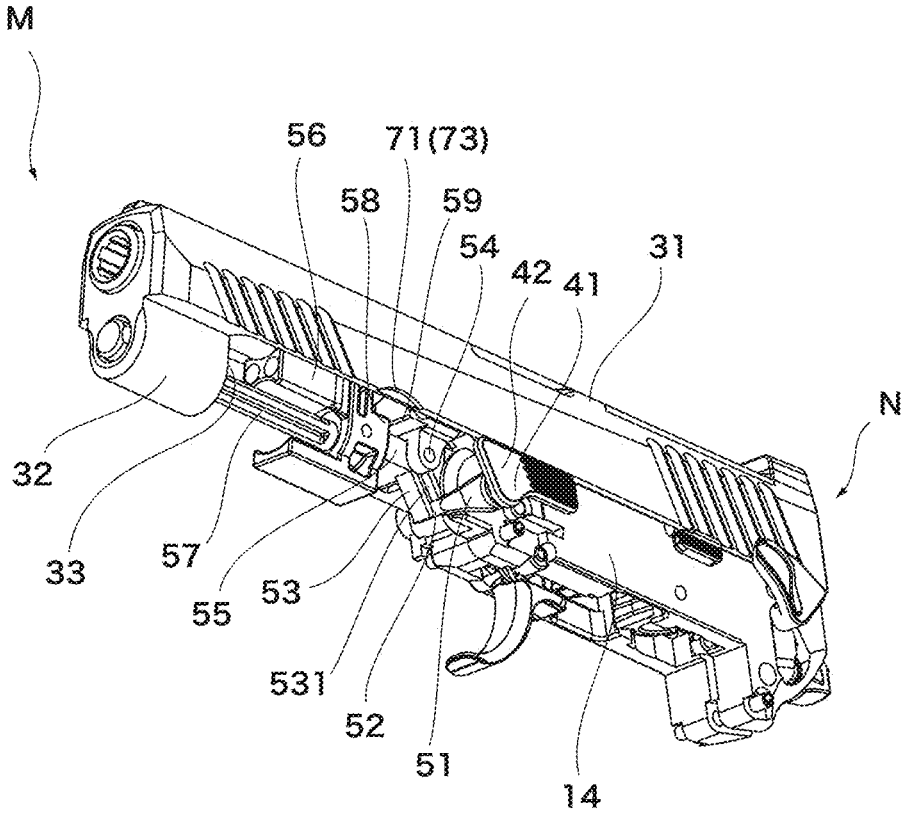
FIG. 3 is a perspective view showing a partially enlarged inner structure of the toy gun as an example of an embodiment according to the present invention, representing the state of the slide before sliding from the toy gun body.

In the state where the slide 31 is kept from sliding from the toy gun body 12, the takedown operation groove 71 is in the state as shown in FIGS. 1, 2, and 3. The slide side takedown operation groove 73 is positioned closer to the muzzle side M of the toy gun body side takedown operation groove 72.

The slide 31 is displaced to the rear end side N until the toy gun body side takedown operation groove 72 is linked with the slide side takedown operation groove 73 to form the arc shape serving as the guide.

The takedown operation groove 71 guides operations of the takedown lever 41.

In the case of non-linkage between the toy gun body side takedown operation groove 72 and the slide side takedown operation groove 73, the takedown operation groove 71 serving as the guide is not formed. Accordingly, the slide 31 does not slide to the rear end side N.

In the case of linkage between the arc shaped toy gun body side takedown operation groove 72 and the arc shaped slide side takedown operation groove 73, the guide is formed. This allows the takedown lever 41 to move along the takedown operation groove 71.

The slide block crank 55 comes directly or indirectly in contact with a part of the slide 31 or a part connected thereto to prevent the slide 31 from moving to the rear end side N. In this example, the slide block crank 55 comes in contact with the slide block 56. The slide block 56 comes in contact with the slide block abutment portion 33 of the shaft support portion 32.

Accompanying with the rotating motion of the takedown lever 41, the slide block crank 55 moves toward the muzzle side M, and vertically downward. In moving toward the muzzle side M, the slide block crank 55 extends closer to the muzzle side M than in moving vertically downward. Accompanying with the rotating motion of the takedown lever 41, the sliding amount of the slide 31 toward the rear end side N varies.

Operations of the example will be described.

When the slide 31 is kept from sliding from the toy gun body 12, it is in the state as shown in FIGS. 1, 2, and 3.

As the slide side takedown operation groove 73 is positioned closer to the muzzle side M compared to the toy gun body side takedown operation groove 72, the takedown operation groove 71 as the guide is not formed.

The takedown lever 41 is horizontally disposed on the side surface of the toy gun body 12 below the slide 31. As the guide is not formed, the takedown convex portion 43 is not guided by the takedown operation groove 71, and accordingly, kept from moving. The takedown lever 41, thus does not rotatingly move.

As shown in FIGS. 2 and 3, the link convex portion 52 attached to the top end of the takedown link 51 engaged with the crank groove 531 formed in the crank 53 is disposed at the top end of the crank groove 531 in the lowermost stage. The slide block crank 55 oppositely attached via the crank shaft 54 horizontally extends toward the muzzle side M at the upper position. The slide block in contact with the slide block crank 55 is pressed toward the muzzle side M.

When the slide 31 has not slidingly moved to reach the rear end as shown in FIGS. 2 and 3, the slide block backward abutment portion 59 is released from the fitted state to the crank abutment portion 58.

Figure 10:
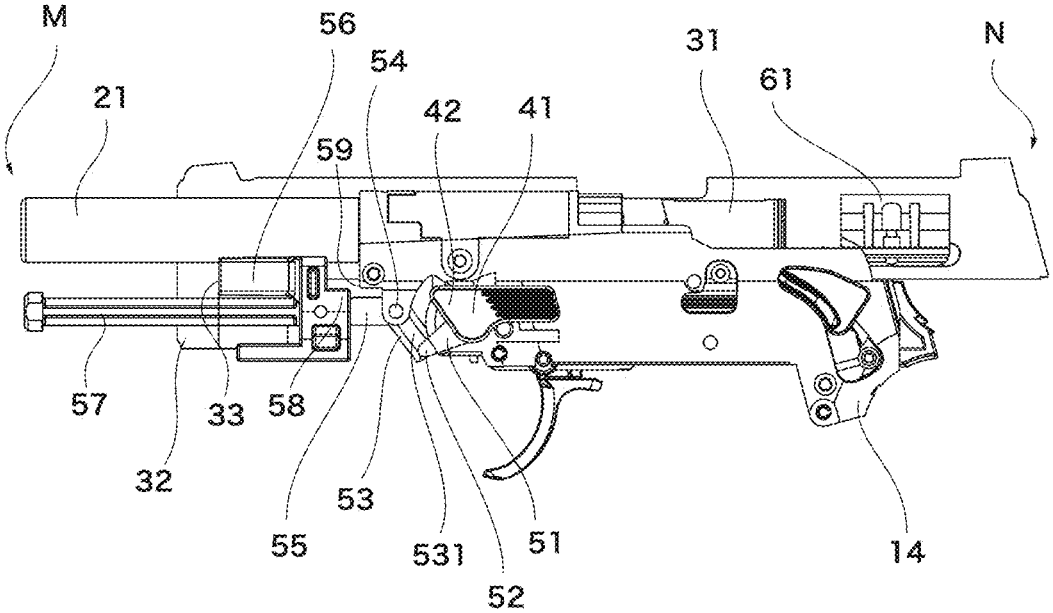
FIG. 10 is a partially enlarged sectional view of the toy gun as an example of an embodiment according to the present invention, representing that the slide is in the state after sliding from the toy gun body, and the takedown lever is in the state before operation.

As shown in FIGS. 4, 9, and 10, the slide 31 is slidingly moved backward.

As the slide 31 is moved toward the rear end side N, the slide side takedown operation groove 73 and the toy gun body side takedown operation groove 72 are vertically overlapped to form the takedown operation groove 71 which is the arc shaped guide.

Although the guide is formed, the takedown lever 41 is not rotatingly moved, and kept horizontally positioned on the side surface of the toy gun body 12 below the slide 31.

As shown in FIGS. 9 and 10, the link convex portion 52 attached to the top end of the takedown link 51 is engaged with the crank groove 531 formed in the crank 53, and positioned at the top end of the crank groove 531 in the lowermost stage. Therefore, the slide block crank 55 oppositely attached via the crank shaft 54 is kept in the horizontal state at the upper position, and directed to the muzzle side M. The slide block in contact with the slide block crank 55 is pushed to the muzzle side M.

The slide block 56 abuts on the slide block abutment portion 33 of the shaft support portion 32 as a part of the slide 31 that has slidingly moved in the direction toward the rear end side N. As the slide block 56 is pushed by the slide block crank 55 to the muzzle side M, the slide 31 is kept from slidingly moving backward any further.

When the slide 31 has not slidingly reached the rear end as shown in FIGS. 9, 10, the slide block backward abutment portion 59 is released from the fitted state to the crank abutment portion 58.

Referring to FIG. 12, as the slide 31 moves toward the rear end side N, the slide side takedown operation groove 73 and the toy gun body side takedown operation groove 72 are vertically overlapped to form the takedown operation groove 71 as the arc shaped guide. The takedown lever 41 is rotatingly moved vertically on the side surface of the toy gun body 12 below the slide 31.

The link convex portion 52 attached to the top end of the takedown link 51 is engaged with the crank groove 531 formed in the crank 53 so that the crank 53 is raised upward in the rotating motion A. Then the slide block crank 55 oppositely attached via the crank shaft 54 rotatingly moves vertically in the rotating motion B and directed downward.

As FIG. 12 shows, a space C is generated between the slide block crank 55 and the slide block 56.

When the slide 31 has not slidingly reached the rear end as shown in FIG. 12, the slide block backward abutment portion 59 is released from the fitted state to the crank abutment portion 58.

Then as shown in FIGS. 13 and 14, the slide 31 may be slidingly moved by the distance corresponding to the space C toward the rear end side N until the slide block 56 comes in contact with the slide block crank 55.

Referring to FIGS. 13, 14, when the slide 31 slidingly reaches the rear end, the slide block backward abutment portion 59 is fitted and fixed to the crank abutment portion 58.

The takedown lever 41 is operated clockwise to rotatingly move the slide block crank 55 around the crank shaft 54 counterclockwise.

The slide 31 may be slidingly moved toward the rear end side N so that the slide 31 is removed from the toy gun body 12.

The slide 31 of the air gun may be detached by operating the single lever without using the tool. This allows the user of the toy gun to easily perform such maintenance as cleaning and oiling. The production efficiency may also be improved to allow easy replacement of the defective slide 31.

In the present invention, the operation is to be performed in accordance with the procedure for operating the real gun which is configured to have the slide detachable together with the barrel toward the muzzle side M. Meanwhile, the blowback gas gun having the air chamber at the rear end side N of the barrel 21 is required to have the slide 31 individually detached toward the rear end side N.

What is claimed is:

1. A device for attachment-detachment of slide for toy gun comprising:

a slide disposed at an upper part of the toy gun body while covering a barrel, and slidingly moving toward a muzzle of the barrel, and toward a rear end side of the toy gun;

a takedown lever disposed on a surface of the toy gun body at a boundary with the slide, the takedown lever being rotatingly movable along the surface of the toy gun body; and a slide block crank that comes in contact with a part of the slide or a part connected to the slide directly or indirectly to prevent the slide from moving toward the rear side of the gun, and moves in a muzzle direction and a non-muzzle direction accompanying with the rotating movement of the takedown lever, the slide block crank being closer to the muzzle in moving in the muzzle direction than in moving in the non-muzzle direction.

2. The device for attachment-detachment of slide for toy gun according to claim 1, further comprising:

a slide block slide shaft to be disposed parallel to the barrel;

a shaft support portion to be slidably attached to the slide block slide shaft below the slide at a side of the muzzle;

a slide block abutment portion that constitutes a side surface of the shaft support portion at the rear side of the gun; and a slide block configured to be attached to the slide block slide shaft to be movable in the muzzle direction and the non-muzzle direction, and to come in contact with the slide block abutment portion of a shaft support portion, wherein the slide block crank comes in contact with the slide block to prevent the slide from moving toward the rear side of the gun.

3. The device for attachment-detachment of slide for toy gun according to claim 1, wherein the slide block crank is movable in the muzzle direction or in the non-muzzle direction, and configured to come in contact with a slide block that contacts with the part of the slide or the part connected to the slide to prevent the slide from moving toward the rear side of the gun.

4. The device for attachment-detachment of slide for toy gun according to claim 1, wherein the slide block crank moves in the muzzle direction accompanying with a horizontal rotating motion of the takedown lever, and moves in the non-muzzle direction accompanying with a vertical rotating motion of the takedown lever.

5. The device for attachment-detachment of slide for toy gun according to claim 1, wherein the slide block crank moves toward the muzzle direction accompanying with the horizontal rotating motion of the takedown lever to come in contact with the slide block abutment portion of the shaft support portion, and vertically moves accompanying with the vertical rotating motion of the takedown lever so that a space is generated between the slide block crank and the slide block.

6. The device for attachment-detachment of slide for toy gun according to claim 1, further comprising a takedown operation groove to be formed across a surface between the slide and the toy gun body for guiding the takedown lever to rotatingly move in a horizontal direction, and to operate in a vertical direction.

7. The device for attachment-detachment of slide for toy gun according to claim 6, wherein the takedown operation groove is formed across the surface between the slide and the toy gun body.

8. The device for attachment-detachment of slide for toy gun according to claim 6, wherein the takedown operation groove includes a toy gun body side takedown operation groove and a slide side takedown operation groove, wherein the toy gun body side takedown operation groove is formed in a surface of the toy gun body, constituting a lower half of an arc shape, wherein the slide side takedown operation groove is formed in a surface of the slide, constituting an upper half of the arc shape, and wherein linkage between the toy gun body side takedown operation groove and the slide side takedown operation groove forms the arc shape serving as a guide.

9. The device for attachment-detachment of slide for toy gun according to claim 6, wherein sliding of the slide toward the rear side of the gun allows the linkage between the toy gun body side takedown operation groove and the slide side takedown operation groove to form the arc shape serving as the guide.

* * * * *